US007513185B1

(12) United States Patent
Könicke

(10) Patent No.: US 7,513,185 B1
(45) Date of Patent: Apr. 7, 2009

(54) MAGAZINE FOR AN AUTOMATIC WEAPON

(75) Inventor: Helmut Könicke, Röthenbach (DE)

(73) Assignee: Diehl BGT Defence GmbH & Co., KG, Überlingen (DE)

( * ) Notice: Subject to any disclaimer, the term of this patent is extended or adjusted under 35 U.S.C. 154(b) by 62 days.

(21) Appl. No.: 11/522,148

(22) Filed: Sep. 15, 2006

(30) Foreign Application Priority Data

Sep. 17, 2005 (DE) ..... 10 2005 044 553

(51) Int. Cl.
*F41A 9/00* (2006.01)

(52) U.S. Cl. ..... 89/33.16; 89/33.1

(58) Field of Classification Search ..... 89/33.16, 89/45, 46, 47, 33.02, 155–156, 165
See application file for complete search history.

(56) References Cited

U.S. PATENT DOCUMENTS

| | | | | |
|---|---|---|---|---|
| 2,717,534 A | | 9/1955 | Atherton, Jr. | |
| 3,505,927 A | * | 4/1970 | Driscoll | 89/135 |
| 4,084,480 A | * | 4/1978 | Moscrip | 89/42.03 |
| 4,278,008 A | * | 7/1981 | Smith et al. | 89/156 |
| 4,282,813 A | | 8/1981 | Sterbutzel | |
| 4,357,857 A | * | 11/1982 | Magnuson | 89/156 |
| 4,506,589 A | | 3/1985 | Junker et al. | |
| 5,347,911 A | | 9/1994 | Hallqvist | |
| 5,811,721 A | * | 9/1998 | Andersson et al. | 89/45 |

FOREIGN PATENT DOCUMENTS

| | | | |
|---|---|---|---|
| BE | 827136 A1 | | 3/1975 |
| DE | 39 13 174 A1 | | 4/1989 |
| DE | 4033755 A1 | * | 4/1992 |
| GB | 494304 A | | 10/1938 |

* cited by examiner

*Primary Examiner*—J. Woodrow Eldred
*Assistant Examiner*—Gabriel J Klein
(74) *Attorney, Agent, or Firm*—Scully, Scott, Murphy & Presser, P.C.

(57) ABSTRACT

An automatic weapon (10), especially for caseless ammunition with the weapon (10) being guided so that it can move linearly in its longitudinal direction in a weapon housing (14), enabling the weapon (10) to recoil unrestrained over a defined recoil distance (P1, P2, . . . ) during a firing burst. A primary magazine (22) for a large number of powder charges (24) and a primary magazine (18) for a large number of projectiles (20) are attached to the weapon housing (14). The weapon (10) has a jointly moving magazine element (26) for a small number of powder charges (24), and a jointly moving magazine element (28) for a small number of projectiles (20) corresponding to the small number of powder charges (24).

8 Claims, 4 Drawing Sheets

MAGAZINE FOR AN AUTOMATIC WEAPON

BACKGROUND OF THE INVENTION

1. Field of the Invention

The invention relates to a magazine for an automatic weapon, especially for utilization in connection with caseless ammunition.

The recoil forces of an automatic weapon affect the handling of the weapon and the oscillation of the weapon barrel so that a known automatic weapon of this kind has a relatively wide scatter of hit pattern. In addition automatic weapons are inclined to kick-up, against the restraining forces (i.e. from round-to-round). An attempt is made to counteract the unrestrained effect of such a stepwise increase in elevation, i.e. kick-up, by limiting the number of rounds either automatically or by gunner intervention. This is, however, possible only to a limited extent because long bursts of fire are also usual. Such long bursts of fire are usually a waste of ammunition.

2. Discussion of the Prior Art

A conventional automatic weapon recoils along a damping path each time a round is fired. This recoil-damping path can be from a few millimeters up to a few centimeters long. After the recoil damping movement, the weapon is again returned to the basic position.

The ammunition feed transport and the ammunition feed are thus usually in a defined position. In such cases, the magazine or the magazine belt feed is usually also fixed.

For an automatic weapon, especially for caseless ammunition where the weapon can move linearly in its axial longitudinal direction in a housing, enabling the weapon to recoil unrestrained along a relatively long recoil path determined and limited by a recoil damper as described in copending German Patent Application No. DE 10 2005 026 978.8-15, a fixed magazine or a belt feed of this kind would mean that a complete magazine, together with all of the ammunition, would always have to travel back with the weapon. With a belt feed, it would be possible for the ammunition belt to be dragged backwards and forwards in great loops.

SUMMARY OF THE INVENTION

The object of the invention, taking account of these circumstances, is to provide a magazine for an automatic weapon of the type mentioned in the introduction, in which the magazine with all of the ammunition does not always have to travel back with the weapon, or the belt feed does not have to drag the ammunition belt backwards and forwards in great loops.

With the automatic weapon according to the invention, a primary magazine for a large number of powder charges and a primary magazine for a large number of projectiles are attached to the weapon housing, and the weapon, that during a firing burst moves backwards unrestrained in the longitudinal direction of the weapon housing along a defined, relatively long recoil path, has a magazine element for a small number of powder charges that travels with it and a magazine element for a number of projectiles corresponding to the number of powder charges that also travels with it. A relatively small magazine element with a limited, defined capacity for powder charges and a corresponding magazine element for projectiles are thus provided on the recoiling weapon. These two magazine elements move with the weapon during the recoil movement. The primary magazine for powder charges, attached to the weapon housing, and the primary magazine for projectiles, attached to the weapon housing transfer a specific small number of powder charges and projectiles to the respectively associated magazine element of the weapon after each firing burst.

With the automatic weapon according to the invention, both primary magazines and both magazine elements can be designed as box-type magazines. The magazines can also be designed as drum magazines or, for example, as stick magazines.

According to the invention, it is also possible for the two primary magazines to have a belt feed device for belted powder charges and an associated powder charge feed star and also a belt feed device for belted projectiles and an associated projectile feed star, with the powder charge feed star and projectile feed star being mounted in the weapon housing parallel to the axis, and with both magazine elements each having a transfer star associated with the projectile feed star and a transfer star associated with the powder charge feed star, with the transfer stars being arranged with their axes parallel to each other and to the axes of the two feed stars mounted on the weapon housing.

The two small magazine elements of the weapon are preferably provided on opposite sides of the weapon barrel of the weapon and axially offset relative to each other in the barrel longitudinal direction, so that the magazines of the automatic weapon according to the invention do not adversely affect each other.

A cross-slide is associated with each of the two small magazine elements of the weapon. One feed element is expediently associated with each of the two cross slides.

With the design of the automatic weapon according to the invention fitted with belt feed devices, the relevant belt feed device pulls the associated belt in until a preset number of rounds, as required for a defined firing burst, are loaded into the associated small magazine element. The relevant belt is then separated. The moving belt feed device positions the ammunition in the loading position. After returning to the basic position, the relevant belt feed device pulls the next required number of rounds into the associated small magazine element and again cuts off the belt. This process is repeated.

With the automatic weapon according to the invention, when the weapon is in the basic position, a corresponding large or primary magazine transfers, e.g. loading strips with a defined amount of ammunition. The ammunition return movement in the particular magazine element can, for example, also be realized by spring pressure or by exerting positive control by means of a control cam.

BRIEF DESCRIPTION OF THE DRAWINGS

Further details, features and advantages are provided in the following description of the exemplary embodiments of the automatic weapon according to the invention as shown in the drawings, wherein.

DETAILED DESCRIPTION OF THE INVENTION

Figure 1:
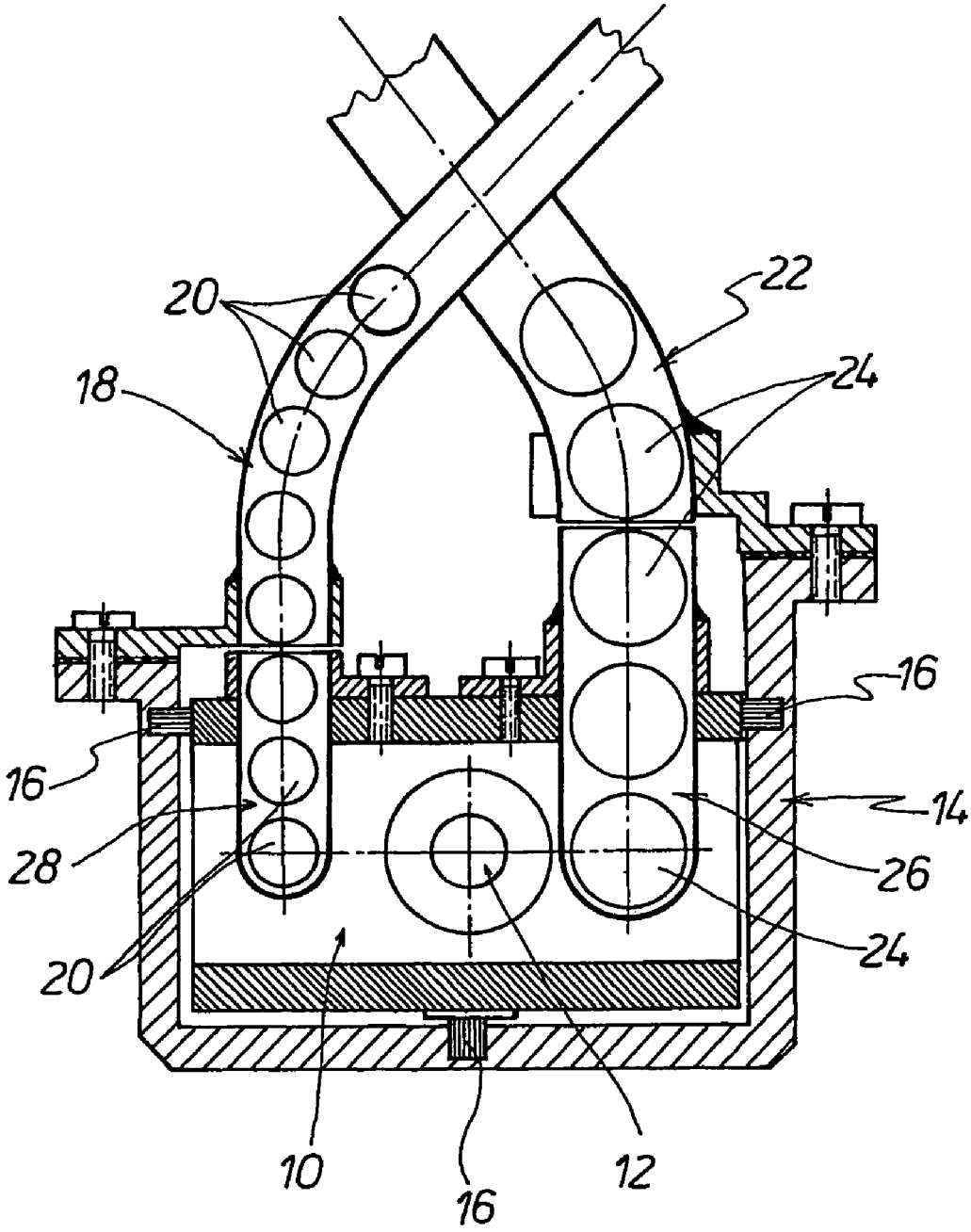
FIG. 1 illustrates a cross-sectional view of a first embodiment of the automatic weapon.

FIG. 1 is a cross-sectional view showing one embodiment of the automatic weapon 10, especially for caseless ammunition. The weapon 10 has a weapon barrel 12 and is guided in a weapon housing 14 in its longitudinal direction, i.e. at right angles to the plane of the drawing (FIG. 1), so that it can move linearly. The weapon 10 can thus recoil unrestrained in the weapon housing 14 over a defined recoil path during a firing burst. For this purpose, the weapon 10 is arranged in the weapon housing 14 by means of guide devices 16 to enable it to move linearly.

A primary magazine 18 for projectiles 20 and a primary magazine 22 for powder charges 24 are attached to the weapon housing 14. The weapon 10 has a magazine element 26 for powder charges 24 and a magazine element 28 for projectiles 20. Both primary magazines 18 and 22 and both magazine elements 26 and 28 are each designed as box magazines.

Figure 2:
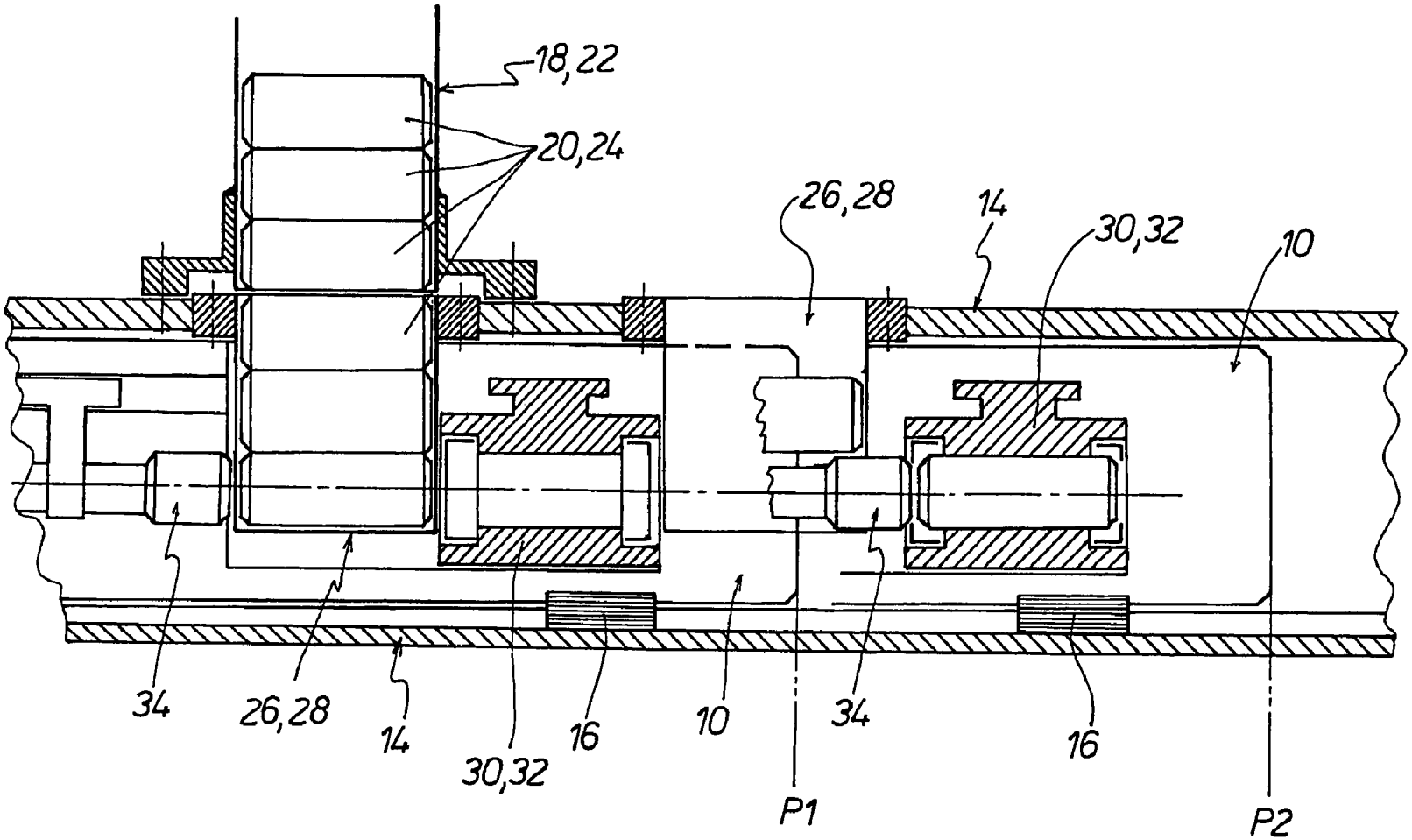
FIG. 2 illustrates a partial longitudinal section view through the weapon shown in FIG. 1.

As can be seen from FIG. 2, in which identical details are designated using the same reference numbers as in FIG. 1, a respective cross-slide 30 or 32 is associated with the magazine element 26 or 28 respectively, and a feed element 34 or 36 is associated with each cross-slide 30, 32. The operation and action of the cross-slides 30 and 32 and of the feed elements 34 and 36 associated with them are explained below in conjunction with FIGS. 4 and 5.

FIG. 2 is, furthermore, a schematic showing a position P1 of the weapon 10 before the first shot and a position P2 of the weapon 10 before the second shot.

Figure 4:
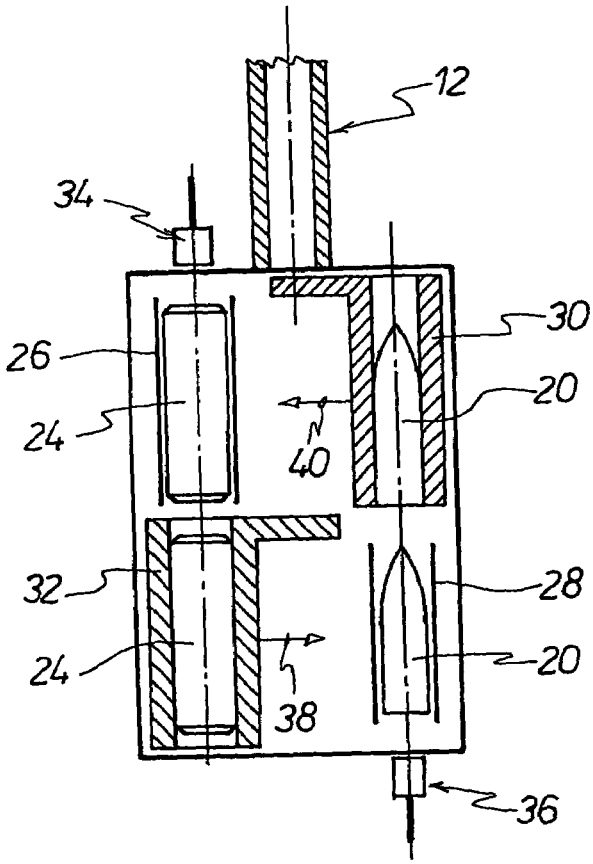
FIG. 4 illustrates a schematic view showing the main details of the weapon, viewed from above in a first operating position.
Figure 5:
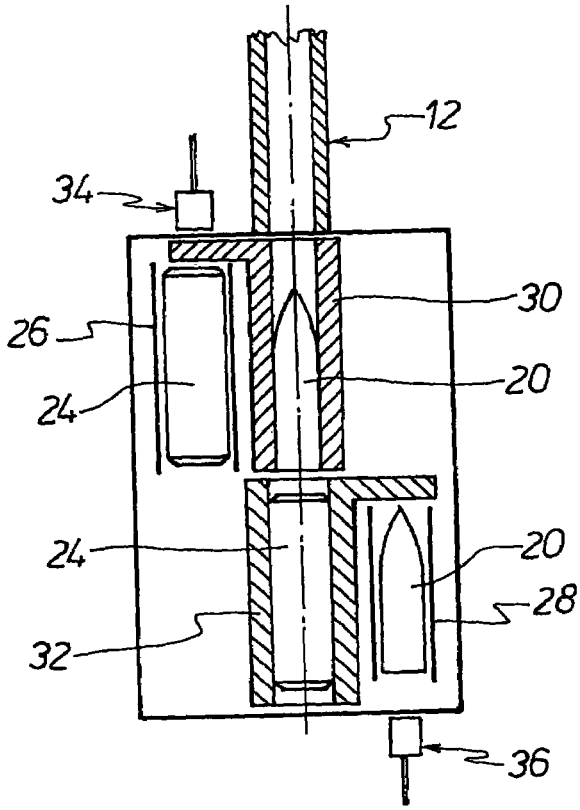
FIG. 5 illustrates an outline view similar to FIG. 4, showing the weapon in a different operating position.

FIG. 4 is a schematic section showing the weapon barrel 12, the magazine element 26 for powder charges 24, the magazine element 28 for projectiles 20, the cross-slide 30 for projectiles 20 and the cross-slide 32 for powder charges 24, and also the feed element 34 associated with the magazine element 26 and the feed element 36 associated with the magazine element 28.

With the aid of the feed element 34, in the position shown in FIG. 4, the powder charge 24 is transferred from the magazine element 26 to the cross-slide 32 and, with the aid of feed element 36, a projectile 20 is transferred from the magazine element 28 to the cross-slide 30. The cross-slide 32 is then moved in the direction of the arrow 38 and the cross-slide 30 in the direction of the arrow 40, so that, as can be seen from FIG. 5, the projectile 20 and the propellant charge 24 are positioned axially aligned with the weapon barrel 12, with the propellant charge 24 then being detonated with the aid of a detonator 42, schematically shown in FIG. 5 by an arrow. The cross-slides 30 and 32 are then returned to the start position again as shown in FIG. 4, so that, after a corresponding recoil of the weapon 10 in the weapon housing 14, the process described with reference to FIGS. 4 and 5 can be repeated.

Figure 3:
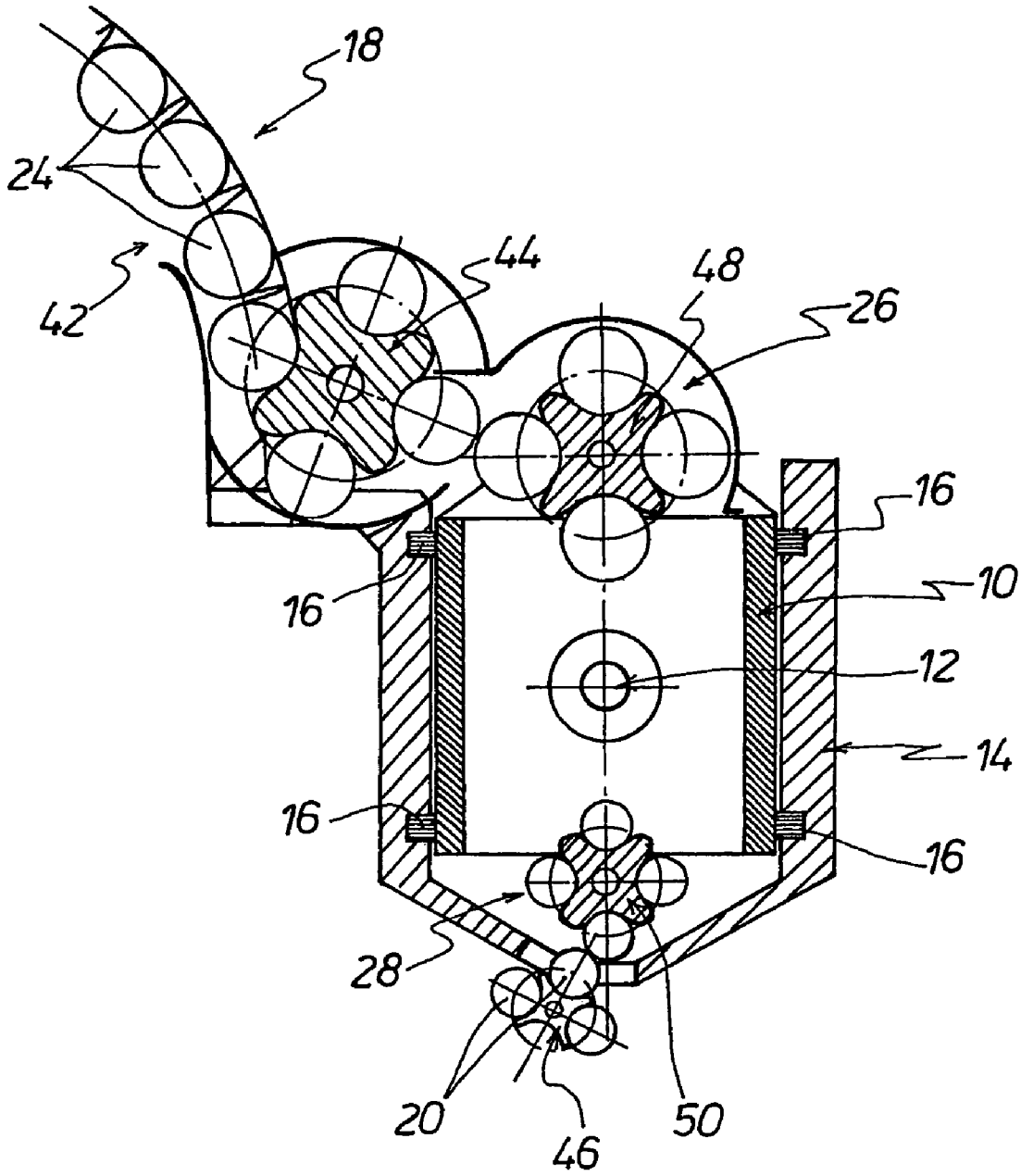
FIG. 3 illustrates a cross-sectional view of another embodiment of the automatic weapon.

FIG. 3 shows an embodiment of the automatic weapon 10 that is guided in a weapon housing 14 in its longitudinal direction such that it can house linearly, at right angles to the plane of the drawing (FIG. 3), so that the weapon 10 can recoil unrestrained in a defined recoil path P1, P2, . . . in the weapon housing 14 during a firing burst. In this embodiment, the two primary magazines have a belt feed device 42 for belted powder charges 24 and a (not illustrated) belt feed device for belted projectiles 20. The belt feed device 42 for the powder charges 24 has a powder charge feed star 44, and the belt feed device for the belted projectiles 20 has an associated projectile feed star 46. Both these feed stars 44 and 46 are rotatably mounted on the weapon housing 14. Their axes are oriented parallel to each other.

Both small magazine elements of the weapon 10 have a transfer star 48 associated with the powder charge feed star 44 and a transfer star 50 associated with the projectile feed star 46. The transfer stars 48 and 50 are arranged parallel to each other and parallel with the axes of the feed stars 44 and 46 mounted on the weapon housing 14.

The weapon barrel of the weapon 10 is also designated with the reference number 12 in FIG. 3.

The transfer stars 48 and 50 form corresponding small magazine elements 26 for the powder charges 24 and projectiles 20.

The axially aligned arrangement of the particular powder charge 24 and associated projectile 20 relative to the weapon barrel 12 for each round of a firing burst can be realized in a manner similar to that for the embodiment shown in FIGS. 1 and 2, as has been described above in conjunction with FIGS. 4 and 5.

The invention can also be used for short, integral cased ammunition. A moving magazine is then provided in a similar manner.

LIST OF REFERENCE NUMBERS

10 Automatic weapon
12 Weapon barrel (of 10)
14 Weapon housing (of 10)
16 Guide device (between 12 and 14)
18 Primary magazine (for 20)
20 Projectile
22 Primary magazine (for 24)
24 Powder charge
26 Magazine element (for 24 in 10)
28 Magazine element (for 20 in 10)
30 Cross-slide (for 20 in 10)
32 Cross-slide (for 24 in 10)
34 Feed element (for 24 at 26)
36 Feed element (for 20 at 28)
38 Arrow/lateral movement (of 32)
40 Arrow/lateral movement (of 30)
42 Belt feed device
44 Powder charge feed star
46 Projectile feed star
48 Transfer star (for 24 in 10)
50 Transfer star (for 20 in 10)

What is claimed is:

1. A magazine for an automatic weapon, said weapon (10) being guided linearly for movement in a weapon housing (14) in a longitudinal direction, the weapon (10) being unrestrainedly recoilable in the weapon housing (14) through a defined recoil distance (P1, P2, . . . ) during a firing burst, wherein a primary magazine (22) for a large number of powder charges (24) and a primary magazine (18) for a large number of projectiles (20) are each attached to the weapon housing (14), said weapon (10) having a magazine element (26) for a small number of powder charges (24) arranged in said weapon housing (14), and being moveable in conjunction with the recoilable movement of the weapon (10), and a magazine element (28) for a small number of projectiles (20), corresponding to the small number of powder charges (24) arranged in said weapon housing (14), and being moveable in conjunction with the recoilable movement of weapon (10).

2. A magazine according to claim 1, wherein both primary magazines (18 and 22) and both said magazine elements (26 and 28) are formed as box magazines.

3. A magazine according to claim 1, wherein both said primary magazines (18 and 22) are formed as drum magazines.

4. A magazine according to claim 1, wherein both said primary magazines (18 and 22) are formed as stick magazines.

5. A magazine according to claim 1, wherein both said primary magazines (18 and 22) include a belt feed device (42) for belted powder charges (24), a powder charge feed star (44), a belt feed device for belted projectiles (20) and an associated projectile feed star (46), said powder charge feed star (44) and the projectile feed star (46) being mounted on the weapon housing (14) oriented parallel to the axis, and both magazine elements (26 and 28) each having a transfer star (50) for projectiles (20) operatively associated with the projectile feed star (46) and a transfer star (48) for powder charges (24) operatively associated with the powder charge feed star (44), said transfer stars being mounted with their axes parallel to each other and parallel to the axes of the two feed stars (44 and 46) of the weapon housing (14).

6. A magazine according to claim 1, wherein said weapon (10) includes a weapon barrel (12), the two magazine elements (26, 28) of the weapon (10) being arranged on opposite sides of and being coextensive with a longitudinal axis of the weapon barrel (12) of the weapon (10), and being axially offset relative to each other along the longitudinal direction of the weapon barrel.

7. A magazine according to claim 6, wherein a cross-slide (30, 32) is operatively associated with each of the two magazine elements (26, 28).

8. A magazine according to claim 7, wherein a feed element (34, 36) is operatively associated with each of the two cross-slides (30, 32) of the magazine elements (26, 28).

* * * * *